US011225739B2

(12) United States Patent
Frey et al.

(10) Patent No.: US 11,225,739 B2
(45) Date of Patent: Jan. 18, 2022

(54) APPARATUS FOR MAKING SPUNBOND FROM CONTINUOUS FILAMENTS

(71) Applicant: Reifenhaeuser GmbH & Co. KG Maschinenfabrik, Troisdorf (DE)

(72) Inventors: Detlef Frey, Niederkassel (DE); Martin Neuenhofer, Roesrath (DE); Sebastian Sommer, Troisdorf (DE)

(73) Assignee: REIFENHAEUSER GMBH & CO. KG, Troisdorf (DE)

( * ) Notice: Subject to any disclaimer, the term of this patent is extended or adjusted under 35 U.S.C. 154(b) by 208 days.

(21) Appl. No.: 15/939,703

(22) Filed: Mar. 29, 2018

(65) Prior Publication Data

US 2018/0282925 A1 Oct. 4, 2018

(30) Foreign Application Priority Data

Mar. 31, 2017 (EP) ..... 17164368

(51) Int. Cl.
*D04H 3/16* (2006.01)
*D01D 5/092* (2006.01)
(Continued)

(52) U.S. Cl.
CPC ..... *D04H 3/16* (2013.01); *D01D 5/092* (2013.01); *D01D 5/0985* (2013.01); *D01D 7/00* (2013.01);
(Continued)

(58) Field of Classification Search
CPC ..... D04H 3/16; D04H 17/00; D01D 5/092; D01D 13/00; D01D 13/02; D01D 4/04;
(Continued)

(56) References Cited

U.S. PATENT DOCUMENTS 4,737,087 A * 4/1988 Hertell ..... F04C 15/0038 277/513
4,790,736 A * 12/1988 Keuchel ..... D01D 5/18 156/436
(Continued)

FOREIGN PATENT DOCUMENTS

DE 10053731 A1 * 5/2001 ..... D01D 5/088
EP 1505180 A1 * 2/2005 ..... D01D 5/08

OTHER PUBLICATIONS

Meise Hansjoerg, "Melt spinning plant for synthetic fibers, includes air cooling section supported on movable height adjuster and sealed against spinneret assembly," (2001) (Year: 2001).*
(Continued)

*Primary Examiner* — Francisco W Tschen
*Assistant Examiner* — Edgaredmanuel Troche
(74) *Attorney, Agent, or Firm* — Andrew Wilford

(57) ABSTRACT

An apparatus for making a nonwoven spunbond web has a spinneret for making endless filaments moving in a predetermined direction. A monomer extractor downstream from the spinneret has an upstream extractor end face directed upstream and forming a gap with a downstream spinneret end face. A cooler downstream of the extractor for the filaments has an upstream cooler end face forming with a downstream extractor end face a second gap. A stretcher downstream of the cooler for the cooled filaments has an upstream stretcher end face forming a third gap with the downstream cooler end face. The filaments are deposited on a web former by the stretcher to form the nonwoven spunbond web. A deformable seal for seals one of the gaps, and means connected to the deformable seal press the seal against the end faces forming the one gap with a variable pressure or contact face.

18 Claims, 4 Drawing Sheets

(51) Int. Cl.

| | |
|---|---|
| ***D01D 5/098*** | (2006.01) |
| ***D04H 3/02*** | (2006.01) |
| ***D04H 3/03*** | (2012.01) |
| ***D01D 13/02*** | (2006.01) |
| ***D01D 7/00*** | (2006.01) |
| ***D02J 1/22*** | (2006.01) |
| ***D04H 3/005*** | (2012.01) |

(52) U.S. Cl.
CPC ..... *D02J 1/225* (2013.01); *D04H 3/005* (2013.01); *D04H 3/02* (2013.01); *D04H 3/03* (2013.01); *D01D 13/02* (2013.01)

(58) Field of Classification Search
CPC .. D01D 4/08; D01D 4/027; D02J 1/225; F16J 15/027; F16J 15/46; F16J 17/10
USPC ..... 425/66, 72.1, 72.2, 80.1; 19/296; 277/128, 304, 363, 387, 431, 457, 512, 277/605
See application file for complete search history.

(56) References Cited

U.S. PATENT DOCUMENTS 5,702,730 A * 12/1997 Reifenhauser ..... D04H 3/02 425/213
5,814,349 A * 9/1998 Geus ..... D04H 3/03 264/176.1
5,891,480 A * 4/1999 Schmidt ..... B29C 55/28 425/66
8,591,213 B2 * 11/2013 Fare' ..... D04H 3/033 425/72.2
2002/0102897 A1 * 8/2002 Berrigan ..... D04H 3/16 442/327
2003/0012835 A1 * 1/2003 Faulenbach ..... D01D 5/092 425/72.2
2006/0040008 A1 * 2/2006 Geus ..... D01D 5/088 425/72.2
2009/0026647 A1 * 1/2009 Geus ..... B29C 48/05 264/40.6
2009/0218721 A1 * 9/2009 Ochiai ..... B29C 48/465 264/212
2009/0256278 A1 * 10/2009 Harris ..... D01D 5/088 264/211.12
2009/0309309 A1 * 12/2009 Schilling ..... F16J 15/061 277/312
2011/0147977 A1 * 6/2011 Sommer ..... D04H 3/005 264/115
2016/0312384 A1 * 10/2016 Goretzki ..... D01D 5/092
2018/0112333 A1 * 4/2018 Hegenbarth ..... D01D 5/092

OTHER PUBLICATIONS

Pawling Engineered Products, Pneuma-Seal Design Guide, 2004, Retrieved from: http://www.sealsunlimited.ca/userFiles/Pneuma-Seal%20Design%20Guide%202004%20from%20Seals%20Unlimited.pdf (Year: 2004).*

* cited by examiner

APPARATUS FOR MAKING SPUNBOND FROM CONTINUOUS FILAMENTS

FIELD OF THE INVENTION

The present invention relates to the manufacture of spunbond. More particularly this invention concerns an apparatus for making spunbond from continuous filaments.

BACKGROUND OF THE INVENTION

The invention relates to an apparatus for making spunbond from endless or continuous filaments, n particular endless filaments of thermoplastic material, comprising at least one spinneret for spinning the endless filaments, at least one monomer extractor, at least one cooler for cooling the filaments, at least one stretcher for stretching the filaments and comprising at least one web former, in particular in the form of a foraminous belt, for receiving and carrying off the filaments as a nonwoven web. Endless filaments means within the scope of the invention filaments having almost endless length. Such endless filaments differ in this respect from staple fibers which have much shorter lengths of for example 10 to 60 mm. With the monomer extractor, gas is extracted from the filament forming space underneath the spinneret. As a result, the gases such as monomers, oligomers, decomposition products and the like which occur along with the endless filaments can be removed from the apparatus according to the invention.

An apparatus of the above-described type is basically known from practice in various embodiments. These apparatuses are also known as spunbond apparatuses. Many of the apparatuses of this type known from practice have the disadvantage that at high filament speeds and high throughputs or production rates, the quality of the filament deposition leaves something to be desired. This particularly relates to the homogeneity of the deposition and the strength of the nonwoven webs produced. High filament speeds and extreme fineness of the product endless filaments can frequently only be achieved with significant loss of quality of the nonwoven webs produced. The known apparatuses are therefore capable of improvement.

OBJECTS OF THE INVENTION

It is therefore an object of the present invention to provide an improved method of making a spunbond web.

Another object is the provision of such an improved method of making a spunbond web that overcomes the above-given disadvantages, in particular in which high filament speeds and very fine filaments as well as high production rates can be achieved and nevertheless, the quality of the filament deposition or the nonwoven web produced meets all the requirements.

SUMMARY OF THE INVENTION

An apparatus for making a nonwoven spunbond web from endless thermoplastic filaments has according to the invention a spinneret for spinning the endless filaments moving in a predetermined filament direction and having a downstream spinneret end face directed downstream. A monomer extractor downstream in the filament direction from the spinneret has an upstream extractor end face directed upstream and forming a gap with the downstream spinneret end face and an opposite downstream extractor end face directed downstream. A cooler downstream of the extractor cools the filaments and has an upstream cooler end face forming with the downstream extractor end face a second gap. A stretcher downstream of the cooler for stretching the cooled filaments similarly has an upstream stretcher end face forming a third gap with the downstream cooler end face. The extractor, cooler, and stretcher form a continuous filament-treatment passage extending in the filament direction. A web former is provided on which the filaments are deposited by the stretcher to form the nonwoven spunbond web. A deformable seal for seals one of the gaps, and means connected to the deformable seal press the seal against the end faces forming the one gap with a variable pressure or contact face.

In other words the invention is an apparatus for making spunbond from endless filaments, in particular from thermoplastic material, comprising at least one spinneret for spinning the endless filaments, at least one monomer extractor, at least one cooler for cooling the filaments, at least one stretcher for stretching the filaments and comprising at least one web former, in particular in the form of a foraminous belt, for deposition of the filaments to form a nonwoven web, wherein at least a first deformable seal for sealing a first gap formed between the spinneret and the monomer extractor is provided between the spinneret and the monomer extractor, and/or at least a second deformable seal for sealing a second gap formed between the monomer extractor and the cooler is provided between the monomer extractor and the cooler, and/or at least a third deformable seal for sealing a third gap formed between the cooler and the stretcher or the intermediate passage is provided between the cooler and the stretcher or an intermediate passage, and the installation properties, in particular the pressing force and/or the pressing pressure and/or the contact surface of the first seal and/or the second seal and/or the third seal are variable or adjustable in relation to the end faces of the respective gap.

The invention is in this respect is based on the discovery that as a result of the sealing according to the invention of the first and/or second and/or third gap, preferably as a result of the sealing of all the gaps, an advantageous influence on the aerodynamic conditions inside the apparatus results. As a result, when implementing the measures according to the invention, nonwoven webs or spunbond having optimal quantity can be produced and specifically in particular very homogeneous nonwoven webs/spunbond can be achieved and this is primarily at high production rates or filament speeds.

In this connection, the invention is furthermore based on the discovery that the surfaces delimiting the gap are exposed to a thermal deformation during operating of the apparatus. To this end, the invention has identified that a seal or that seals are expedient which reliably seal even with different gap widths or gap heights, in particular transversely to the machine direction (MD) or in the CD direction, even at high internal pressures of for example above 2500 Pa. The high internal pressures or cabin pressures of for example over 2500 Pa are primarily typical at high filament speeds or production rates. Different gap widths or gap heights, in particular transversely to the machine direction (MD) or in the CD direction, are also obtained as a result of a sagging of apparatus components as a result of their weight or due to a deformation or bending of apparatus components as a result of high internal pressures or cabin pressures.

The invention is based on the discovery that for these reasons a seal or seals are useful whose installation properties are variable or adjustable in relation to the boundary regions or end faces of the respective gap. With such a seal according to the invention, different gap widths or gap heights over the length or width of the gap formed between the said apparatus components can be compensated and thus the gap can be effectively sealed.

"Machine direction" (MD) means within the scope of the invention in particular the normally horizontal conveying direction of the filaments deposited as a nonwoven web on the deposition device or on the foraminous belt. "CD direction" means in particular the direction transverse to the machine direction (MD).

A quite particularly preferred embodiment of the invention is characterized in that both the first gap between spinneret and the monomer extractor and also the second gap between the monomer extractor and the cooler and the third gap between the cooler and the stretcher or the intermediate passage is sealed by at least one deformable seal whose installation properties are variable or adjustable in each case in relation to at least one end face of the respective gap.

It lies within the scope of the invention that the width of the first gap between the spinneret and the monomer extractor and/or the width of the second gap between the monomer extractor and the cooler and/or the width of the third gap between the cooler and the stretcher or the intermediate passage in the operating state of the apparatus is 3 to 35 mm, and preferably 5 to 30 mm. The respective at least one first seal and/or at least one second seal and/or at least one third seal then seals over the relevant width of the respective gap. Non-uniformities in relation to the width of the first gap and/or in relation to the width of the second gap and/or in relation to the width of the third gap can each be compensated by variation/readjustment of the installation properties, in particular the pressing force and/or the pressing pressure and/or the contact surface, of the respective seal in the width direction. Width of a gap means within the scope of the invention according to a preferred embodiment, the height or the vertical height of the respective gap. According to another preferred embodiment however, this can also be, in particular with a corresponding configuration of the apparatus components, a horizontal width of the respective gap or a width of the respective gap provided geometrically differently.

It is recommended that at least one seal, preferably the at least one first seal and/or the at least one second seal and/or the at least one third seal, is/are adjustable or deformable in the width direction of the associated gap by a deformation path of 3 to 20 mm, preferably of 4 to 18 mm and very preferably of 5 to 15 mm. This means in particular that the at least one seal can be deformed from a first state by the said deformation path toward the width of the associated gap into a second state or can be enlarged in relation to the deformation path and conversely. In this case, the deformation or readjustment can preferably be accomplished passively or automatically, in particular as a result of the pressure of a fluid medium prevailing inside the seal, or the deformation or readjustment can be accomplished actively, in particular as a result of the increase or reduction in the pressure of a fluid medium prevailing inside the seal.

A very preferred embodiment of the invention is characterized in that the at least one first seal runs around over the entire circumference or substantially over the entire circumference of the filament flow passage F running between the spinneret and the monomer extractor and/or that the at least one second seal runs around over the entire circumference or substantially over the entire circumference of the filament flow passage F running between the monomer extractor and the cooler and/or that the at least one third seal runs around over the entire circumference or substantially over the entire circumference of the filament flow passage F running between the cooler and the stretcher or the intermediate passage. In these preferred cases, the at least one respective seal therefore runs around the respective filament flow passage F both in the CD direction and in the MD direction.

According to another embodiment of the invention, in the first gap and/or in the second gap and/or in the third gap, in each case a multiplicity of seals is provided adjacent to one another and this multiplicity of seals delimits the filament flow passage F in relation to the respective gap. It is therefore also possible that in at least one gap in the CD direction and/or in the MD direction, a plurality of seals are provided adjacent to one another or at one another and thus form first seals in the gap between spinneret and monomer extractor and/or second seals in the gap between monomer extractor and cooler and/or third seals in the gap between cooler and stretcher.

A particularly recommended embodiment of the invention is characterized in that the at least one first seal and/or the at least one second seal and/or the at least one third seal is substantially or predominantly deformable in a principal direction of deformation. According to one embodiment, the principal direction of deformation is aligned parallel to the filament flow direction or substantially parallel to the filament flow direction and/or preferably vertically or substantially vertically. According to another embodiment, the principal direction of deformation of the at least one seal or the seals is aligned perpendicular to the filament flow direction or substantially perpendicular to the filament flow direction and/or is preferably aligned horizontally or substantially horizontally. According to one embodiment, the deformation of the at least one first seal and/or the at least one second seal and/or the at least one third seal is delimited or restricted transversely to the respective principal direction of deformation by seal guides provided adjacent to or at the respective seal.

According to a preferred embodiment, the at least one first seal is fixed between spinneret and monomer extractor on the monomer extractor and the principal direction of deformation is provided from the monomer extractor toward the spinneret, wherein at least end face for the at least one first seal is provided on the spinneret on which the at least one first seal comes to rest. In principle, the at least one first seal could also be fixed on the spinneret and the principal direction of deformation is then provided from the spinneret toward the monomer extractor, wherein at least one end face for the at least one first seal is then provided on the monomer extractor. One embodiment of the invention is characterized in that the at least one second seal between monomer extractor and cooler is fixed on the monomer extractor and the principal direction of deformation is provided from the monomer extractor toward the cooler, wherein at least one end face for the at least one second seal is provided on the cooler on which the at least one second seal comes to rest. In principle, the at least one second seal could also be fixed on the cooler and the principal direction of deformation is then provided from the cooler toward the monomer extractor wherein at least one end face for the at least one second seal is then provided on the monomer extractor. A recommended embodiment is characterized in that the at least one third seal between cooler and stretcher or intermediate passage is fixed on the stretcher or on the intermediate passage and the principal direction of deformation is then provided from the stretcher or from the intermediate passage toward the cooler, wherein preferably at least one end face for the at least one third seal is provided on the cooler. In principle, the at least one third seal could also be fixed on the cooler and the principal direction of deformation is then aligned from the cooler to the stretcher or to the intermediate passage wherein then the at least one end face for the at least one third seal is provided on the stretcher or on the intermediate passage. As a result of the arrangement of the seal or the seal(s) according to the invention, an effective compensation for deformations or sagging of the apparatus components can take place by means of the deformation of the seal(s). As a result of the readjustment of the seals according to the invention, an effective abutment of the seals against the assigned contact surfaces can take place despite the irregularities.

Preferably the first seal and/or the second seal and/or the third seal is adapted with the proviso that a seal is accomplished at a pressure in the filament flow passage F of more than 2000 Pa, in particular of more than 2500 Pa. Such high pressures are produced in particular at high filament speeds. With the seal according to the invention, it is achieved that at such high pressures or at high filament speeds and correspondingly extreme fineness of the endless filaments produced, a high-quality filament deposition, in particular a largely homogeneous filament deposition in all directions is achieved.

A quite particularly recommended embodiment of the invention is characterized in that the at least one first seal and/or the at least one second seal and/or the at least one third seal is fillable or is filled with a fluid medium. A preferred embodiment of the invention is characterized in that the at least one first seal and/or the at least one second seal and/or the at least one third seal is automatically readjusted or deformed as a result of the pressure of the fluid medium prevailing in the seal in the case of variations or deformations of the associated gap. Advantageously the pressure of the fluid medium in the respective seal is adjusted with the proviso that the seal deformation or seal readjustment takes place automatically in the case of gap width variations, for example, as a result of saggings of apparatus components, and preferably within the preferred deformation path specified further above. Alternatively or additionally according to one embodiment, the readjustment or adjustment of the respective seal is accomplished by introducing the fluid medium into the seal or by removing the fluid medium from the seal. It lies within the scope of the invention here that by introducing the fluid medium into the seal the pressure of the fluid medium in the seal is increased and that by removing the fluid medium from the seal the pressure of the fluid medium in the seal is reduced. Furthermore, it lies within the scope of the invention that the pressure of the fluid medium in one of the seals is the same or substantially the same in all seal regions and that preferably the pressing force of the seal is different at different boundary regions or end faces of the respective gap.

According to a very preferred embodiment of the invention, the fluid medium which can be introduced into the seals or which is contained in the seals is a gas and in particular air. Advantageously the at least one first seal and/or the at least one second seal and/or the at least one third seal can be inflated with the fluid medium in the form of a gas or in the form of air. In order to reduce the pressure or air pressure in the respective seal, the fluid medium or the gas, in particular air can be released from the seal again.

Advantageously the wall or at least wall parts of the at least one first seal and/or the at least one second seal and/or the at least one third seal consists or consist of at least one elastomer or of an elastomer. According to one embodiment of the invention, the first seal and/or second seal and/or third seal can be an annular seal running around over the filament formation space.

The seals adapted according to the invention are very helpful during maintenance pf the apparatus according to the invention and specifically in particular if the apparatus is to be transferred from its operating state into a maintenance state. It lies within the scope of the invention that for transfer of the apparatus into a maintenance state, the installation properties, at least of one seal, in particular the seals are variable so that the apparatus components delimiting the gap to be sealed in each case are displaceable or movable relative to one another in this maintenance state, in particular are displaceable or movable in the horizontal direction or approximately in the horizontal direction.

A preferred embodiment of the apparatus according to the invention is characterized in that for transfer of the apparatus into a maintenance state, the volume or the seal volumes of at least one seal, in particular the seals or all the seals is/are variable or reducible so that a seal-free minimal width or minimal height of at least one gap, in particular of the gap or all the gaps remains. In this maintenance state, installation components can preferably be displaced or moved relative to one another, and specifically in particular can be displaced or moved in the horizontal direction. For example, the volume of a seal or the seals can be reduced at the cooler so that a seal-free minimal width or minimal height of the gap between cooler and monomer extractor and/or of the gap between cooler and stretcher is obtained. The cooler can then be displaced horizontally for cooling purposes or withdrawn from the apparatus.

An alternative embodiment of the invention is characterized in that one or at least one deformable seal comprises at least one sealing element pressed by means of at least one spring element against a end face of the gap to be sealed. Advantageously the dimensions and/or the spring deflection and/or the spring stiffness of the spring element are dimensioned with the proviso that a sealing contact or a seal contact of the sealing element with the associated end face of the gap to be sealed is ensured. The sealing element can for example be a sealing lip which is preferably connected to a spring element. It is recommended that the installation properties of at least one seal or at least one spring-loaded sealing element are adjustable by means of at least one manipulation element which influences or acts upon the spring element. Preferably the apparatus can be transferred into a maintenance state by this adjustment of the installation properties of at least one spring-loaded sealing element.

In the apparatus according to the invention, the monomer extractor is provided downstream of the cooler for cooling the filaments in the filament flow direction. According to a preferred embodiment of the invention, the cooler has only one cooling chamber section in which the through-flowing endless filaments are subjected to cooling air. According to another recommended embodiment of the invention, the cooler has at least two cooling chamber sections provided consecutively or under one another in the filament flow direction in which the through-flowing endless filaments can each be subjected to cooling air at different temperature. The apparatus can also be adapted with the proviso that the exit speed of the process air from an upper cooling chamber for cooling the filaments and the exit speed from a lower cooling chamber is different.

It is recommended that the unit is formed from the cooler and the adjoining stretcher in the filament flow direction as a closed unit, and that apart from the supply of cooling air in the cooler no further supply of a fluid medium or no further air supply into this unit or into this closed unit takes place. The implementation of such a closed unit has proved particularly successful with a view to solving the technical problem of the invention.

It lies within the scope of the invention that at least one diffusor is disposed between the stretcher and the web former or the foraminous belt so that filaments and primary air pass from the stretcher into the diffusor. According to a very preferred embodiment which has quite particular importance within the scope of the invention, in the region of the at least one diffusor at least two secondary air inlet gaps provided on opposite sides of the diffusor are provided, through which secondary air passes into the diffusor. A particularly recommended embodiment of the invention is characterized in that at least one secondary air inlet gap, preferably at least two secondary air inlet gaps are formed with the proviso that the secondary air flows in at an inflow angle $\alpha$ with respect to the filament flow direction FS or with respect to the longitudinal central plane M of the apparatus or the diffusor. According to one embodiment, the inflow angle $\alpha$ can be between 75° and 115°, advantageously between 80° and 110°. According to one embodiment, the inflow angle $\alpha$ is equal to 90° or less than 90°, preferably less than 80°, preferably less than 70° and particularly preferably less than 65°. In this case, it has proved particularly successful that the inflow angle $\alpha$ is less than 60°, preferably less than 55° and preferably less than 50°. According to a very recommended embodiment, the inflow angle $\alpha$ is between 0 and 60°, advantageously between 1 and 55°, preferably between 2 and 50°, very preferably between 2 and 45° and particularly preferably between 2 and 40°. It is particularly recommended that the inflow of secondary air takes place with the proviso that after its entry the secondary air flows parallel or quasi-parallel to the filament flow direction FS. Advantageously the secondary air inlet gaps are adapted accordingly to achieve the inflow angle $\alpha$, in particular adapted with the aid of inflow slopes and/or inflow passages and the like. The implementation of the inflow angle $\alpha$ according to the invention for the secondary air has proved particularly successful within the scope of the invention and makes an efficient contribution to the solution of the technical problem according to the invention.

It is recommended that in the area of the secondary air inlet gaps, the ratio of the volume flows of primary air and secondary air VP/VS is less than 5:1nd preferably less than 4.5:1 Advantageously in the filament flow direction FS a convergent region of the diffusor follows downstream of or underneath the secondary air inlet gaps. Preferably in the filament flow direction FS this convergent region of the diffusor is followed by a constriction of the diffusor and this constriction is preferably followed by at least one divergent region of the diffusor. It is recommended that the diffusor outlet angle $\beta$ of this divergent diffusor section with respect to the longitudinal central axis M of the diffusor is a maximum of 30°, preferably a maximum of 25°.

It lies within the scope of the invention that the last diffusor section in the filament flow direction FS has diffusor walls which diverge towards the web former or towards the foraminous belt and that these diffusor walls form a diffusor outlet having a width B in the machine direction (MD).

Preferably at least one extractor for extracting air or process air through the deposition device or through the foraminous belt is provided. According to a very preferred embodiment of the invention, an extraction region provided underneath the diffusor outlet having a width b in the machine direction is provided, wherein this width b of the extraction region is greater than the width B of the diffusor outlet. It is recommended that the width b of the extraction region is at least 1.2 times, preferably at least 1.3 times and particularly preferably at least 1.4 times the width B of the diffusor outlet. In this case it lies within the scope of the invention that in relation to the machine direction (MD) downstream of the deposition region of the filaments the extraction region projects by a (first) extraction section beyond the diffusor outlet and/or that in relation to the machine direction (MD) upstream of the deposition region of the filaments, the extraction region projects by a (second) extraction section beyond the diffusor outlet. Preferably the extraction region or the main extraction region project on both sides in relation to its width b beyond the width B of the diffusor outlet and specifically on one side by the first extraction section and on the other side by the second extraction section.

A very recommended embodiment of the invention is characterized in that the extraction by the extractor takes place with the proviso that at least in the region of the diffusor outlet, tertiary air flows along the outer surface of the diffusor walls toward the web former or foraminous belt. The tertiary air flows are preferably aligned parallel or substantially parallel to the mixed flow of primary air and secondary air flowing toward the diffusor outlet inside the diffusor. It lies within the scope of the invention that tertiary air is also extracted through the web former or through the foraminous belt. Advantageously the volume flow of tertiary air VT extracted with the extractor is at least 25%, preferably at least 40% and particularly preferably at least 50% of the volume flow of extracted primary and secondary air flows. A recommended embodiment of the invention is characterized in that the distance between the diffusor or between the lower edge/the lowest edge of the diffusor and the foraminous belt is 20 to 300 mm, in particular 30 to 150 mm and preferably 30 to 120 mm. This embodiment has proved particularly successful within the framework of the invention for solving the technical problem according to the invention.

The invention is based on the discovery that with the apparatus according to the invention, nonwoven webs or spunbond with exceptional quality and in particular with very homogeneous properties can be produced in a simple and efficient manner. This applies in particular at high production rates or at high filament speeds and accordingly extreme fineness of the endless filaments. At high internal pressures of the apparatus according to the invention according to the discovery of the invention, the seal provided according to the invention can ensure optimal ratios or aerodynamic ratios in the apparatus. With the measures according to the invention, a very uniform air flow or a uniform filament air flow inside the apparatus is possible and nonwoven webs having largely homogeneous properties in all directions are obtained. It should be emphasized that the apparatus according to the invention is relative simple and not too expensive to implement and in particular can be operated.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
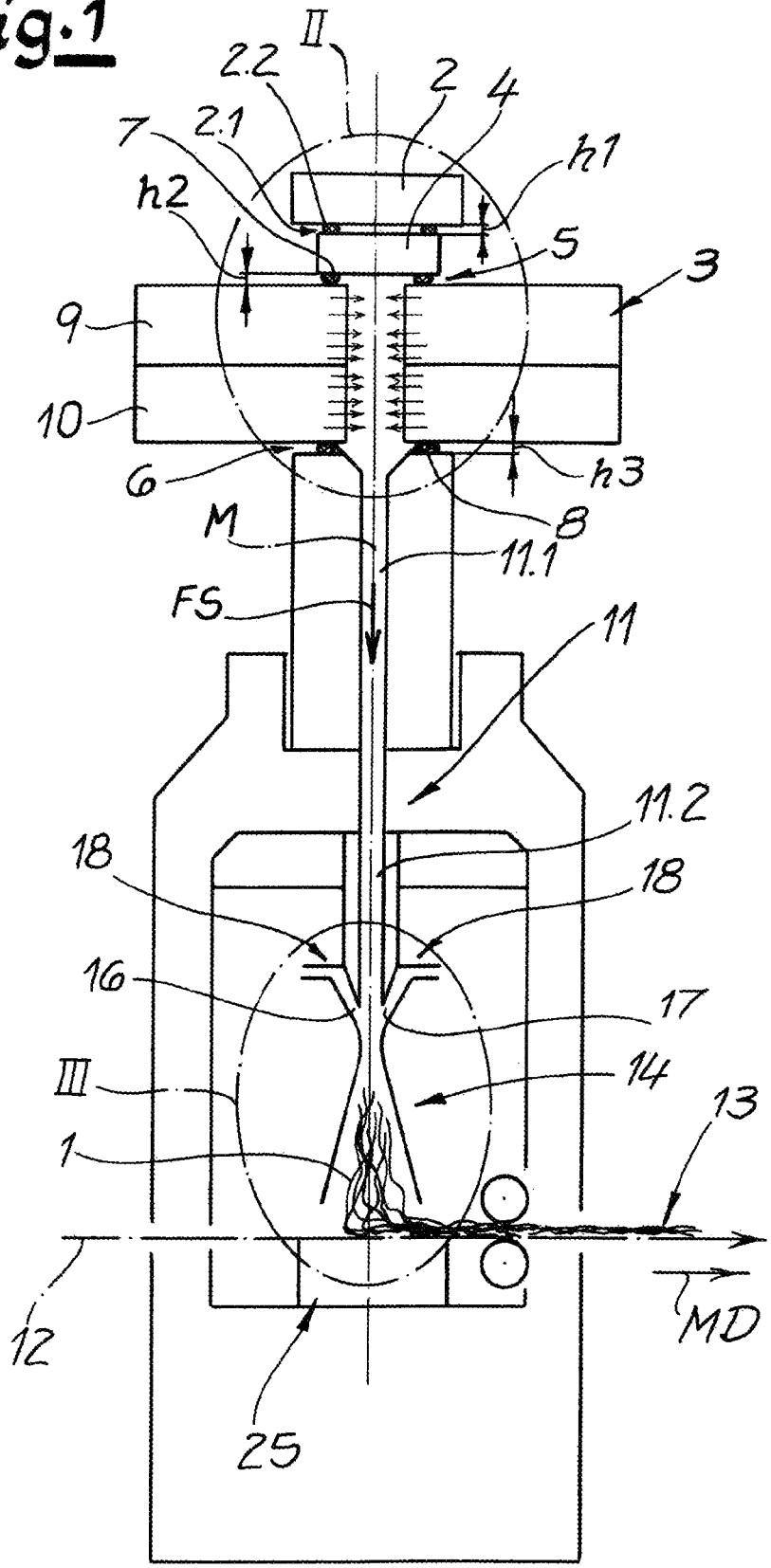
FIG. 1 is a vertical section through an apparatus according to the invention.

The drawing shows an apparatus according to the invention for making spunbond of endless filaments 1, in particular thermoplastic filaments 1. The apparatus comprises a spinneret 2 for spinning the endless filaments 1 as well as a monomer extractor 4 provided in a filament flow direction FS underneath and downstream of the spinneret 2. With the monomer extractor 4, unwanted spinning-process gas, such as in particular monomers or oligomers, can be removed from the apparatus.

A cooler 3 for the filaments 1 is provided downstream of the monomer extractor 4 in the filament flow direction FS. Advantageously and here, the cooler 3 is divided into two cooling chambers 9 and 10 succeeding one another consecutively or under one another in the filament flow direction FS, so that the cooling chambers 9 and 10 preferably and here can be supplied with cooling air at different temperatures. The cooler 3 can however also have only a single cooling chamber.

A stretcher 11 for stretching the filaments 1 is provided downstream of the cooler 3 of the apparatus according to the invention. The stretcher 11 has an intermediate passage 11.1 connected upstream with the cooler 3 or its downstream cooling chamber 10 as well as a stretching shaft 11.2 extending downward and downstream from the intermediate passage 11.1. The intermediate passage 11.1 of the stretcher 11 is preferably and here configured to converge downward in the filament flow direction FS.

Figure 2:
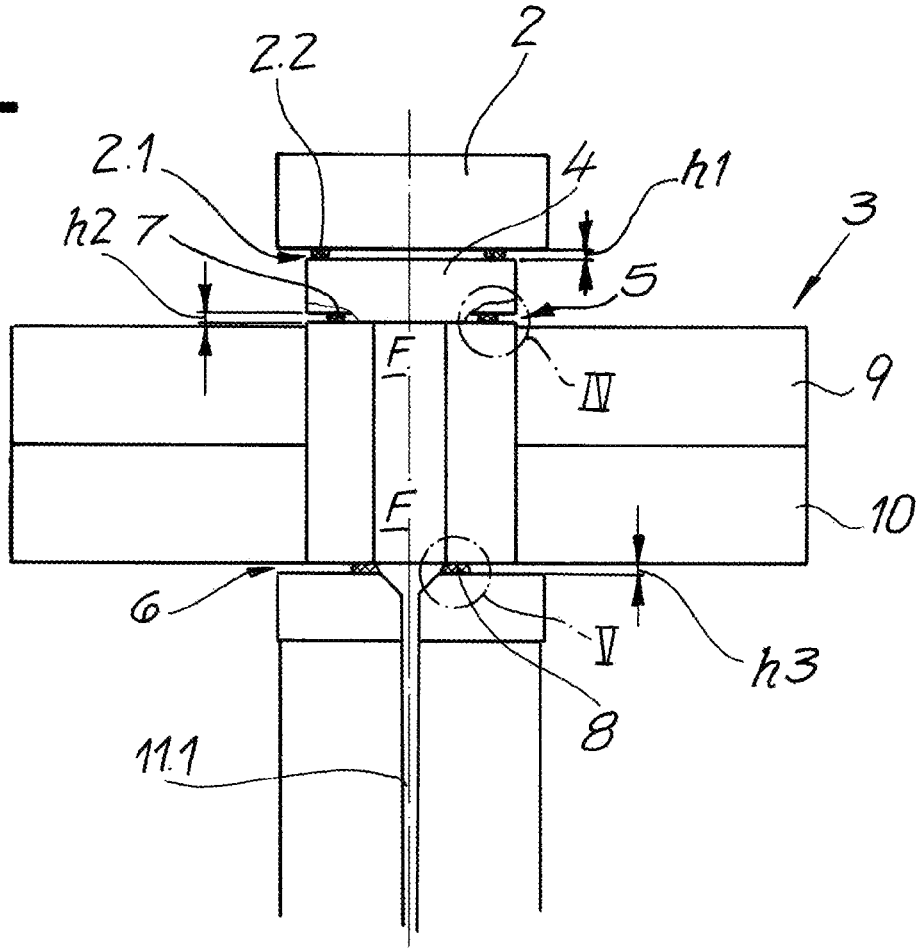
FIG. 2 is a large-scale view of the detail indicated at II from the upper region of the apparatus according to the invention.

Between the spinneret 2 and the monomer extractor 4 is a first gap 2.1 (FIG. 2) that usually and here runs around the entire filament flow space F. In addition, a second gap 5 is provided between the monomer extractor 4 and the cooler 3 that normally and here also runs around the entire filament flow space F. Furthermore, a third gap 6 is formed between the cooler 3 or the lower cooling chamber 10 and the stretcher 11 or the intermediate passage 11.1 of the stretcher 11 which usually and here also runs around the entire filament flow space F. According to a particularly preferred embodiment and here, a first seal 2.2 is provided in the first gap 2.1 to seal the first gap 2.1 and a second seal 7 is provided in the second gap 5 to seal the second gap 5. Furthermore it is recommended and here that a third seal 8 is provided in the third gap 6 to seal the third gap 6. "Sealing" here means in particular that the filament forming space or filament flow space F is sealed with respect to the outside by the seals 2.2, 7, and 8 and leaks are avoided as far as possible. Preferably and here, the first seal 2.2, the second seal 7 and the third seal 8 each comprise a seal ring 2.2, 7, and 8 or annular seal running around the filament flow space F. The three seals 2.2, 7, and 8 are in particular configured as deformable seals 2.2, 7, and 8 and are in particular variable or adjustable in relation to their installation properties, in particular in relation to their pressing force, and relative to the end faces delimiting the respective gaps 2.1, 5, and 6. "Adjustable" here means in particular that the seals 2.2, 7, and 8 are deformable toward of the end faces defining the gaps 2.1, 5, and 6 so that the seals 2.2, 7, and 8 abut snarlingly firmly or tightly against the end faces defining the gaps 2.1, 5, and 6. The first gap 2.1, the second gap 5 and the third gap 6 can have a height $h^1$, a height $h^2$ and a height $h^3$ here which lies between 5 and 30 mm. The respective seals 2.2, 7, and 8 seal the gaps 2.1, 5, and 6 each over the respective height $h^1$ or $h^2$ or $h^3$. Non-uniformities of the respective heights $h^1$, $h^2$ or $h^3$ of the gaps 2.1, 5, and 6 can each be compensated out by the variation/adjustment of the installation properties according to the invention, in particular the pressing force, of the seals 2.2, 7, and 8.

Figure 4:
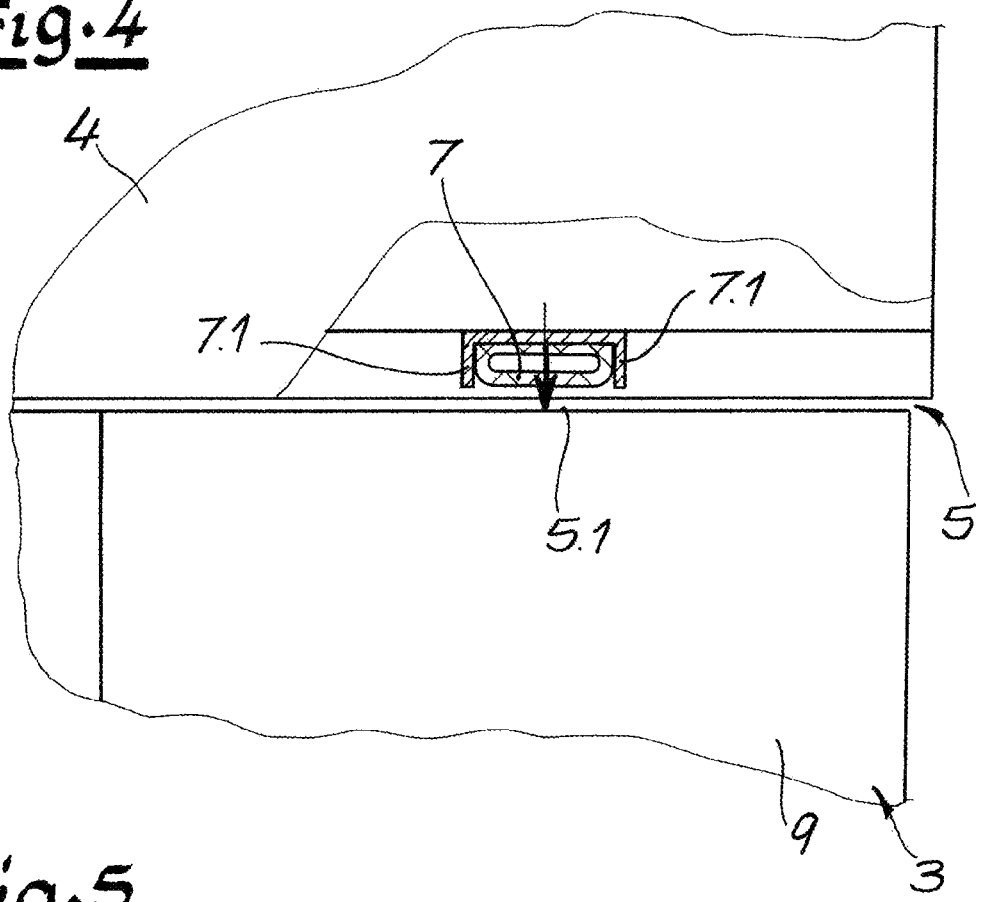
FIG. 4 is a large-scale view of the detail indicated at IV in FIG. 2.
Figure 5:
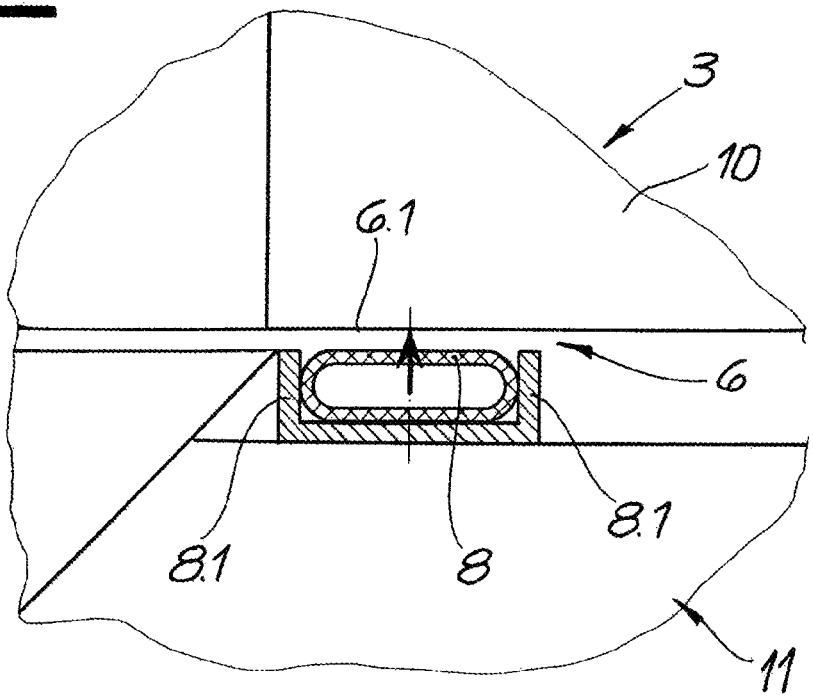
FIG. 5 is a large-scale view of the detail indicated at V in FIG. 2

According to a particularly recommended embodiment of the invention and here, all three seals 2.2, 7, and 8 are each substantially or predominantly controlledly deformable in a principal direction of deformation. The principal direction of deformation is preferably and here parallel to the filament flow direction FS and vertical. Advantageously and here, the principal direction of deformation of the seals 2.2, 7, and 8 is in each case aligned toward the opposite end face of the respective gaps 2.1, 5, and 6. In FIGS. 4 and 5 only the end faces 5.1 and 6.1 of the two gaps 5 and 6 are shown. According to a recommended embodiment and here the deformation of the seals 2.2, 7, and 8 is delimited or restricted by seal guides provided next to the respective seals 2.2, 7, and 8 and extending vertically in the direction FS. In FIGS. 4 and 5 only the seal guides 7.1 and 8.1 are shown next to the seals 7 and 8.

With reference in particular to FIGS. 4 and 5, it is recommended that the second seal 7 is fixed between the monomer extractor 4 and the cooler 3 on the lower end face of the monomer extractor 4 and the principal direction of deformation of this second seal 7 is provided from the monomer extractor 4 downward toward the cooler 3. The second seal 7 then comes to rest on the upper end face 5.1 of the second gap 5 provided on the upper side of the cooler 3. According to a preferred embodiment and here, the third seal is fixed between the cooler 3 and the stretcher 11 or the intermediate passage 11.1 on the stretcher 11 or on the upper end face of the intermediate passage 11.1 and this third seal 8 can expand upwards from the intermediate passage 11.1 toward the cooler 3. This third seal 8 then comes to rest on the lower end face 6.1 of the cooler into the third gap 6. As a result of the described preferred arrangement of the seals 7 and 8 and their preferably provided principal directions of deformation, in particular deformations or sagging of the cooler 3 which take place, in particular in the CD direction, are compensated for and the gaps 5 and 6 here can be effectively sealed with the respective seals 7 and 8 according to the invention.

According to a preferred embodiment and here according to FIGS. 1 to 5 all the seal rings 2.2, 7, and 8 are elastic and can be or are filled with a gas. The gas is advantageously air. The readjustment or adjustment of the installation properties of the seals 2.2, 7, and 8 is accomplished in particular by introducing the gas or air into the seal 2.2, 7, and 8 or by withdrawing the gas or air from the seal 2.2, 7, and 8. It lies within the scope of the invention that the seals 2.2, 7, and 8 are inflatable or inflatable rings 2.2, 7, and 8. By inflating the pressing force of the seals 2.2, 7, and 8, the vertical spacing of the end faces defining the gaps 2.1, 5, and 6 can be varied and the seals 2.2, 7, and 8 can in this way compensate for irregularities in gap height $h^1$, $h^2$, or $h^3$. The walls of the seals 2.2, 7, and 8 here can consist of an elastomer. Preferably the seals 2.2, 7, and 8 are annular seals or tubular seals 2.2, 7, and 8. Advantageously the seals 2.2, 7, and 8 are adapted with the proviso that a sealing takes place at a pressure in the filament flow space F of more than 2000 Pa, in particular of more than 2500 Pa.

It is recommended and here that the subassembly formed from the cooler 3 and the stretcher 11 is closed, and apart from the supply of cooling air in the cooler 3 no further supply of a fluid or air into this closed unit takes place.

The stretched filaments 1 are deposited on a foraminous belt 12 to form a nonwoven web 13. Advantageously and here a diffusor 14 is provided between the stretcher 11 and the web former 12 so that filaments 1 and primary air P pass from the stretcher 11 into the diffusor 14. Preferably and here, two opposite secondary air inlet gaps 16, 17 for introducing secondary air S are provided between the stretcher 11 or between the stretching shaft 11.2 of the stretcher 11 and the diffusor 14. Advantageously the secondary air inlet gaps 16, 17 extend over the entire CD width of the apparatus according to the invention. According to a very preferred embodiment, the secondary air is supplied through the secondary air inlet gaps 16, 17 at an inflow angle $\alpha$ preferably less than 60° and very preferably between 2° and 50°. In order to achieve the inflow angle $\alpha$, here suitably adapted inflow guides 18 are provided that here are configured as inflow passages 19 connected obliquely to the secondary air inlet gaps 16, 17. In this case, the inflow passages 19 form the angle $\alpha$ with the filament flow direction FS or with the longitudinal central axis M so that the secondary air S can flow in at the given inflow angle $\alpha$.

According to a particularly preferred embodiment, a quasi-parallel inflow of secondary air S takes place with respect to the filament flow direction FS. Advantageously the volume flow of secondary air S supplied through the secondary air inlet gaps 16, 17 can be adjusted. As a result of the inflow of the secondary air S through the secondary air inlet gaps 16, 17, primary air P is mixed with secondary air S in the diffusor 14. According to a preferred embodiment, in the region of the secondary air inlet gaps 16, 17 the ratio of the volume flows of primary air and secondary air VP/VS is less than 5:1 and preferably less than 4.5:1.

Here the diffusor 14 has a convergent diffusor section 20 downstream of or underneath the secondary air inlet gaps 16, 17. Preferably and here, this convergent diffusor section 20 is followed by a constriction 21 of the diffusor 14. In the filament flow direction FS downstream of or underneath the constriction 21 the diffusor 14 is preferably and here provided with a divergent diffusor section 22. Advantageously and here, the diffusor outlet angle $\beta$ between a diffusor wall 23 of the divergent diffusor section 22 and the longitudinal central axis M of the diffusor 14 is a maximum of 25°.

The endless filaments 1 emerging from the diffusor 14 or from the divergent diffusor section 22 are deposited on the deposition device configured as a foraminous or mesh belt 12 for filament deposition or to form the nonwoven web 13. The nonwoven web 13 is the conveyed or transported away by the belt 12 in the machine direction MD. It lies within the scope of the invention that an extractor fan is provided for extracting air or process air downward through the deposition device or through the foraminous belt 12 underneath the downwardly open diffuser 14. To this end, an extraction region 25 is provided underneath the diffusor outlet 24 which preferably has a width b in the machine direction MD. The width b of the extraction region 25 is preferably and here greater than the width B of the diffusor outlet 24. According to a preferred embodiment, the width b of the extraction region 25 is at least 1.2 times, preferably at least 1.3 times the width B of the diffusor outlet 24. Here the width B of the diffusor outlet 24 is measured as the horizontal spacing between the lower ends of the diffusor walls 23 perpendicular to the direction MD. If the ends of the diffusor walls 23 of the divergent diffusor section 22 do not end on the same horizontal plane or do not end at the same vertical height, the spacing of the end of the longer diffusor wall 23 from the end an extension of the shorter diffusor wall 23 is measured at the same vertical height.

Figure 3:
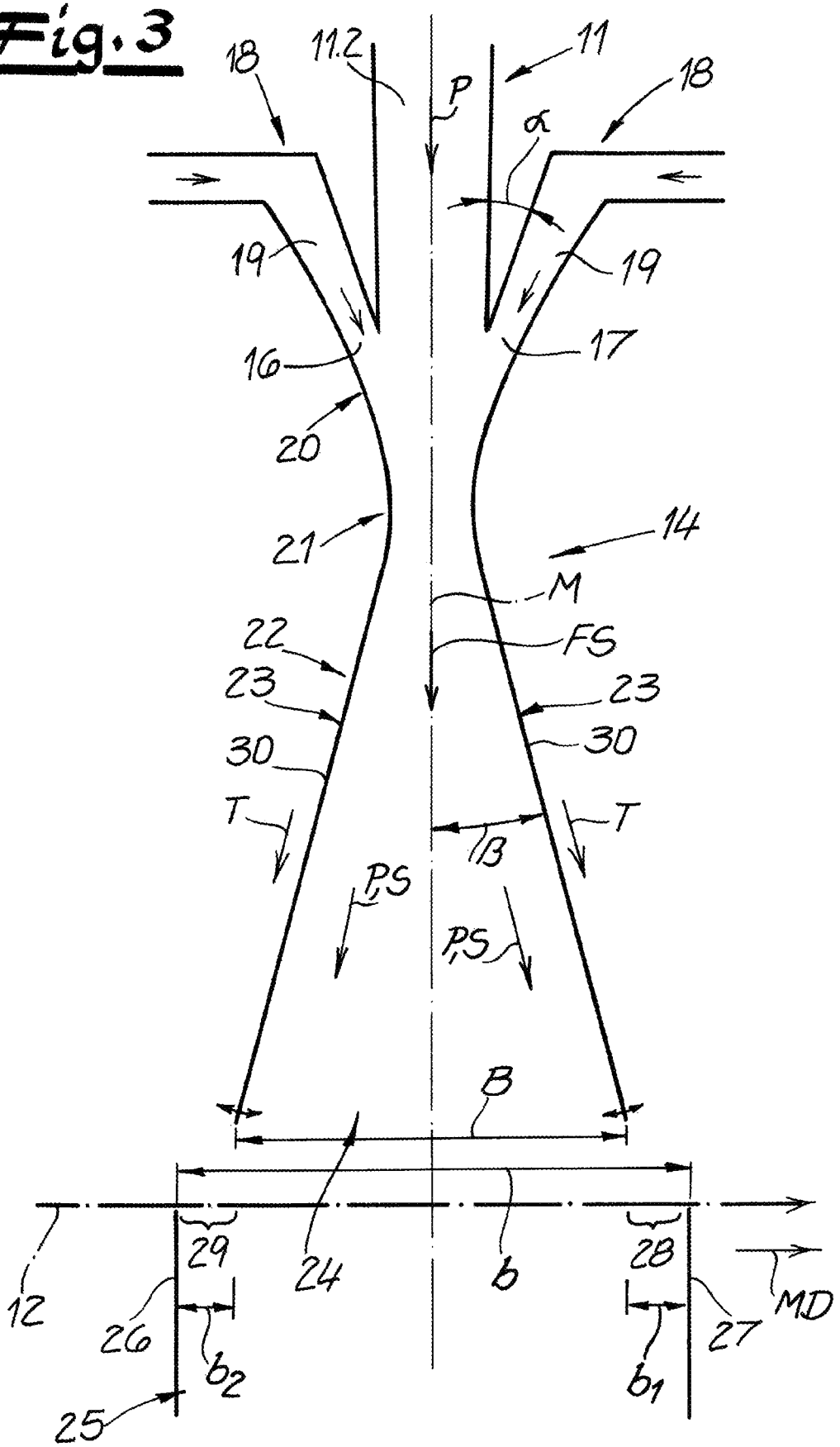
FIG. 3 is a large-scale view III of the detail indicated at III from a lower region of the apparatus according to the invention.

The extraction region 25 located underneath the foraminous belt 12 is delimited by two partitions 26, 27 provided extending parallel to each other in the machine direction MD, which is also the direction in which the finished nonwoven web is transported away from the diffuser 14. The width b of the extraction region 25 is measured as the distance between the two partitions 26, 27 and specifically is the spacing the upper ends or edges of the two partitions 26, 27. FIG. 3 shows that relative to the machine direction MD downstream of the deposition region of the filaments 1 the extraction region 25 projects by a first extraction section 28 beyond the diffusor outlet 24 or past the width B of the diffusor outlet 24. Furthermore preferably and here, in relation to the machine direction MD upstream of the deposition region of the filaments 1, the extraction region 25 projects oppositely by a second extraction section 29 beyond the diffusor outlet 24 or beyond the width B of the diffusor outlet 24. It can be seen in FIG. 3 that the first extraction section 28 has a width $b_1$ and the second extraction section 29 has a width $b_2$. In principle, it also lies within the scope of the invention that the extraction region 25 for its part is subdivided by at least one partition or by partitions. It then applies preferably however that in this extraction region 25 or in this extraction region 25 divided by partitions, the speed or the average speed of the extracted air is the same or substantially the same over the entire width of the extraction region 25.

According to a recommended embodiment of the invention, the extraction by the foraminous belt 12 takes place with the proviso that in the region of the diffusor outlet 24, tertiary air T flows along outer faces 30 of the diffusor wall 14 or the divergent diffusor section 22 toward the foraminous belt 12. According to a particularly preferred embodiment, the flows of the tertiary air T are aligned parallel or substantially parallel to the mixed flow of primary air P and secondary air S flowing toward the diffusor outlet 24 of the diffusor 14. Preferably the flows of primary air P, secondary air S and tertiary air T flow parallel or quasi-parallel through the foraminous belt 12.

Figure 6:
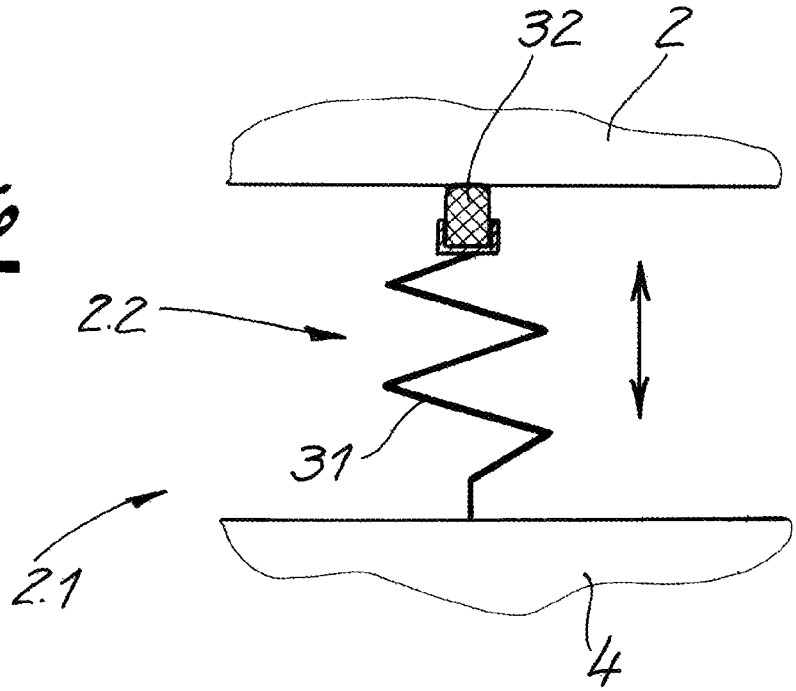
FIG. 6 is a large-scale view like FIG. 2 with an alternative seal.

FIG. 6 shows an alternative embodiment of a seal 2.2 according to the invention that here seals the first gap 2.1 between the spinneret 2 and the monomer extractor 4. This alternative seal 2.2 comprises a seal element 32 pressed by a spring 31 onto one of the end faces defining the gap 2.1 to be sealed, which sealing element is for example a sealing lip.

We claim:

1. An apparatus for making a nonwoven spunbond web from filaments that are thermoplastic and continuous, the apparatus comprising:

a spinneret for spinning the filaments in a predetermined direction and having a downstream spinneret end face directed downstream in the predetermined direction;

a monomer extractor downstream in the predetermined direction from the spinneret and having an upstream extractor end face directed upstream and forming a first gap with the downstream spinneret end face, the monomer extractor having an opposite downstream extractor end face directed downstream;

a cooler downstream of the extractor for cooling the filaments and having an upstream cooler end face forming with the downstream extractor end face a second gap and an opposite downstream cooler end face;

a stretcher downstream of the cooler for stretching the cooled filaments and having an upstream stretcher end face forming a third gap with the downstream cooler end face, the extractor, the cooler, and the stretcher forming a continuous passage extending in the predetermined direction;

a web former on which the filaments are deposited by the stretcher to form the nonwoven spunbond web;

a deformable hollow seal in the second gap, fillable with a fluid medium for sealing between the respective end faces, fixed to the monomer extractor, and having a principal direction of deformation extending in the predetermined direction toward the cooler;

another deformable hollow seal in the third gap, fillable with a fluid medium for sealing between the respective end faces, fixed to the stretcher, and having a principal direction of deformation extending in the predetermined direction toward the cooler; and means connected to the deformable seals for introducing the fluid medium into the seals or removing the fluid medium from the seals for pressing the seals against the respective end faces forming the respective gaps with a variable pressure or contact force and thereby varying a dimension of the seals in the predetermined direction to compensate for non-uniformities of a dimension of the respective gaps between the respective end faces in the predetermined direction and maintain the seals in contact with both of the respective end faces.

2. The apparatus defined in claim 1, wherein there are three such seals, one being provided in each of the gaps, each of the seals being connected to the means.

3. The apparatus defined in claim 1, wherein the dimension in the predetermined direction of the first gap between the spinneret and the monomer extractor or the width of the second gap between the monomer extractor and the cooler or the width of the third gap between the cooler and the stretcher when the apparatus is operating is 3 to 35 mm and the respective seal seals across this dimension.

4. The apparatus defined in claim 3, wherein the dimensions in the predetermined direction of the seals is adjustable in the predetermined direction in the gap by 3 to 20 mm.

5. The apparatus defined in claim 1, wherein the seals extend s annularly around the passage.

6. The apparatus defined in claim 1, wherein a plurality of the seals are arranged adjacent to one another in the one gap.

7. The apparatus defined in claim 1, wherein the means for pressing can press the seal against the end faces of the respective gap with a pressure of more than 2000 Pa.

8. The apparatus defined in claim 1, wherein the seals are inflatable.

9. The apparatus defined in claim 1, further comprising:

means usable during maintenance of the apparatus for shortening the seals in the predetermined direction and thereby permitting relative movement in a direction transverse to the predetermined direction of the end faces defining the one gap.

10. The apparatus defined in claim 9, wherein shortening of the seal moves the seals out of contact with one of the respective end faces forming the respective gap.

11. The apparatus defined in claim 1, wherein the cooler and the stretcher form a subassembly closed to entry of air from outside the passage.

12. The apparatus defined in claim 1, further comprising:

a diffuser between the stretcher and the web former, forming part of the passage, receiving the filaments from the stretcher, and having secondary air inlet gaps through which secondary air passes into the diffusor.

13. The apparatus defined in claim 12, wherein the web former includes a foraminous belt on which the filaments are deposited by the diffuser, the apparatus further comprising:

extractor means juxtaposed with the web former for drawing tertiary air in the predetermined direction through the belt and along outer surfaces of the diffusor so as to mix with primary air flowing in the predetermined direction through the passage.

14. The apparatus defined in claim 13, wherein the belt and a region of the belt underneath the diffuser has a width at least 20% greater than a width of the diffuser at a downstream end of the diffuser walls.

15. The apparatus defined in claim 12, wherein a ratio of volume flows of the primary and secondary air is less than 5:1.

16. The apparatus defined in claim 12, wherein walls of the diffuser converge downstream of the secondary air inlet gaps.

17. The apparatus defined in claim 16, wherein after converging at a constriction downstream in the predetermined direction from the secondary air inlet gaps, the walls of the diffuser diverge.

18. The apparatus defined in claim 12, wherein the secondary air inlet gaps open into the diffuser at an angle of less than 100° to the predetermined direction.

* * * * *